United States Patent [19]

Glinert

[11] 4,132,311

[45] Jan. 2, 1979

[54] TAPE CARTRIDGE/CASSETTE RECEPTACLE

[75] Inventor: Floyd Glinert, Englewood Cliffs, N.J.

[73] Assignee: Shorewood Packaging Corp., New York, N.Y.

[21] Appl. No.: 837,733

[22] Filed: Sep. 29, 1977

[51] Int. Cl.[2] ..... B65D 85/672

[52] U.S. Cl. ..... 206/387; 206/563; 206/564; 220/4 E; D87/1 D

[58] Field of Search ..... 206/387, 562, 563, 564, 206/588, 587, 592; 220/4 E; D9/182, 235, 242; D87/1 D

[56] References Cited

U.S. PATENT DOCUMENTS

| | | | |
|---|---|---|---|
| 226,146 | 1/1973 | Price | 206/387 |
| 229,122 | 11/1973 | Price | D87/10 |
| 238,110 | 12/1975 | Shyers | D87/1 D |
| 238,111 | 12/1975 | Shyers | D87/1 D |
| 3,640,379 | 2/1972 | Weingarden | 206/387 |
| 3,743,081 | 7/1973 | Roberg et al. | 206/387 |
| 3,756,383 | 9/1973 | Kryter | 206/387 |
| 3,776,374 | 12/1973 | Medendorp | 206/387 |
| 3,830,363 | 8/1974 | Liber | 206/387 |
| 4,003,468 | 1/1977 | Berkman | 206/387 |

*Primary Examiner*—William Price
*Assistant Examiner*—Bruce H. Bernstein

[57] ABSTRACT

A receptacle for selectively alternatively holding a standard recording tape cartridge or cassette which are of different dimensions includes a rectangular tray shaped member having a rectangular base wall and upstanding front, rear and end walls delineating a cavity for nesting the standard cartridge. Opposing medial rectangular recesses are formed in the front and rear walls and each is delineated by bottom and side shoulders and a vertical base and is open at its top, the distance between the wall recess bases is equal to the length of the standard cassette. In one form the receptacle is formed with a peripheral coplanar flange terminating in an upwardly directed lip to form a recess for receiving a pamphlet and in another form a pair of shallow receptacles is provided, each having a peripheral flange, the edges of a corresponding lip thereof being joined by a self hinge.

4 Claims, 8 Drawing Figures

TAPE CARTRIDGE/CASSETTE RECEPTACLE

BACKGROUND OF THE INVENTION

The present invention relates generally to improvements in receptacles and it relates particularly to an improved receptacle for accomodating and positionally firmly retaining therein articles of different dimensions such as standard recording tape cartridges and cassettes.

The conventional standard recording tape cartridges and cassettes are of approximate shallow rectangular configuration but of different dimensions. The standard cartridge is longer, wider and deeper than the standard cassette and the length of the cassette is somewhat greater than the width of the cartridge. By reason of the differences in the sizes of the cartridges and cassettes, different size receptacles and shipping containers are employed for the cartridges and cassettes and this practice possesses numerous drawbacks and disadvantages. The storing, shipping and dispensing of both cartridges and cassettes, interchangeably, are awkward and inconvenient and require a high inventory of receptacles and shipping containers since the conventional cartridge receptacle and container cannot be used for cassettes and the conventional cassette receptacle and container cannot be used for cartridges. The conventional standard cartridge and cassette receptacles otherwise leave much to be desired.

SUMMARY OF THE INVENTION

It is a principal object of the present invention to provide an improved receptacle.

Another object of the present invention is to provide an improved multifunctional receptacle for accomodating and positionally retaining any of a plurality of articles of different shapes or dimesions.

Still another object of the present invention is to provide an improved receptacle for selectively alternatively housing and positionally retaining a standard tape recording cartridge or cassette.

A further object of the present invention is to provide a device of the above nature characterized by its simplicity, low cost, ruggedness, reliability, ease of use and application, and high versatility and adaptability.

The above and other objects of the present invention will become apparent from a reading of the following description taken in conjunction with the accompanying drawings which illustrate preferred embodiments thereof.

In a sense the present invention contemplates the provision of a receptacle for selectively alternatively holding and positionally retaining a standard tape recording cartridge or cassette which are of rectangular configuration and of different dimensions, said receptacle being integrally formed and comprising a rectangular base wall and front, side and rear peripheral walls projecting upwardly from the edges of said base wall and delineating an open topped cavity in which said cartridge is at least partially nestable, said front and rear peripheral walls having formed in their confronting faces opposed open-topped rectangular recesses bordered by side shoulders and a bottom shoulder and provided with a base wall, the distance between the side shoulders of a respective recess being approximately equal to the width of the standard cassette and the distance between opposing recess bases being approximately equal to the length of said standard cassette.

In a preferred form of the improved receptacle the height of the cavity side walls is approximately the height of the standard cartridge and the height of the recesses is approximately equal to the height of the standard cassette. Coplanar wide and narrow peripheral flanges project from the front and rear and the the side wall top edges respectively, and the flanges terminate in upstanding lips to delineate a shallow recess for receiving a pamphlet or the like and the lips join depending skirt walls. Finger-accomodating recesses are medially formed in the upper portion of each recess base wall. According to another embodiment of the present invention a pair of similarly shaped tray members are provided and are of shapes similar to that described above but lack the skirt wall and peripheral lip and the depth of the cavity is half that of the standard cartridge and of the recess half that of the standard cassette. The pair of trays are joined along adjacent parallel longitudinal flange edges by an integrally formed self hinge.

The improved receptacle selectively alternatively accomodates and firmly houses a standard cartridge or cassette, is simple, inexpensive, easy to use and of great versatility and greatly facilitates and expedites the handling, dispensing, shipping and storing of both the cartridges and cassettes, intermingled.

DESCRIPTION OF THE PREFERRED EMBODIMENTS

Figure 1:
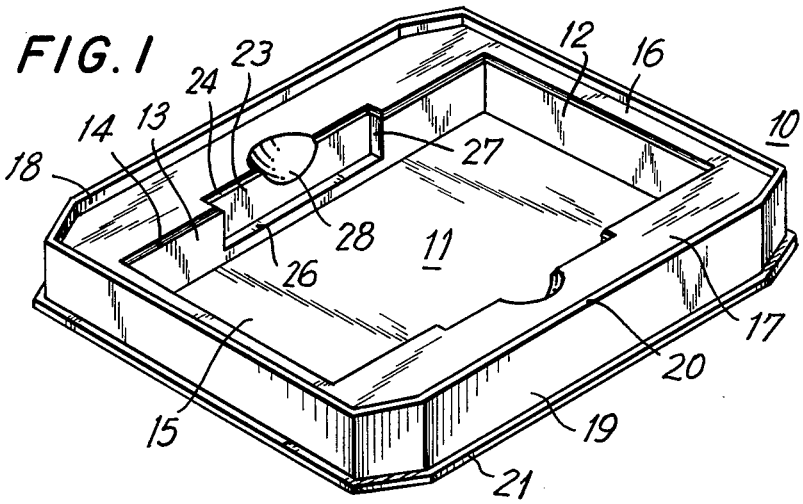
FIG. 1 is a top perspective view of a receptacle embodying the present invention.

Referring now to the drawings, particularly FIGS. 1 to 5 thereof, which illustrate a preferred embodiment of the invention, the reference numeral 10 generally designates the improved receptacle which is shaped and dimensioned to selectively alternatively separably house and positionally retain a standard recording tape cartridge A or a standard recording tape cassette B. The cartridge A and cassette B are of conventional retangular configuration with the respective dimensions of cartridge A being greater than the dimensions of cassette B and the length of cassette B being somewhat greater than the width of cartridge A. The receptacle 10 is fabricated in any suitable manner, for example, by pressure forming advantageously of a termoplastic synthetic organic polymeric resin such as a polyolefin, polystyrene and the like.

The receptacle 10 includes a rantangular base wall 11 of about the length and width of cartridge A and upstanding rectangular peripheral end or side walls 12 and front and rear longitudinal walls 13 which project upwardly from corresponding edges of base wall 11, the walls 12 and 13 being bevelled at their tops, as at 14.

The walls 11, 12 and 13 delineate an open topped rectangular cavity 15 for releasably nesting a cartridge A, being of the same dimensions as the cartridges.

Projecting outwardly from the upper edges of side walls 12 are horizontal narrow flanges 16 and projecting outwardly from the upper edges of front and rear walls 13 are wide horizontal flanges 17 coplanar with flanges 16. The flanges 16 and 17 terminate in upwardly projecting peripheral lips 18 which are integrally joined to depending vertical rectangular skirt walls 19 by narrow horizontal junction flanges 20, the skirt walls 19 terminating at their bottoms in narrow outwardly directed horizontal wall reinforcing flanges 21 coplanar with cavity base wall 11.

The cavity front and rear walls 13 have confronting longitudinally medially located open-topped recesses 22 formed therein. Each recess 22 includes a flat vertical base 23 terminating in a bevelled top edge 24, a flat horizontal shoulder 26 extending along the bottom edge of base 23 and located above the level of cavity base wall 11 and vertical side shoulders 27 extending along the end edges of recess base 23. The height and width of each recess 22 are about equal to that of a cassette 13 and the distance between recess bases 23 is about equal to the length of a cassette B. Medially formed in the upper edge 24 is a concavity 28 facilitating the removal of a cassette B whose ends engage the recesses 22 and rest on shoulders 26.

Figure 2:
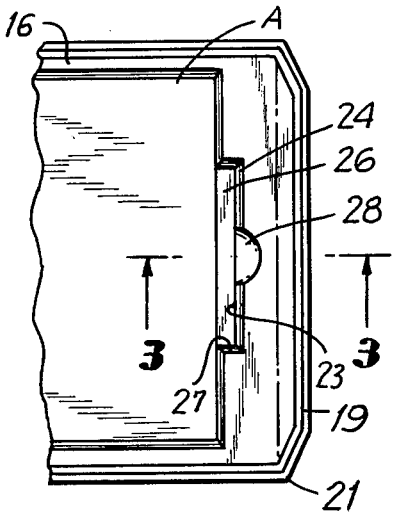
FIG. 2 is a fragmentary top plan view thereof shown holding a standard cartridge.
Figure 4:
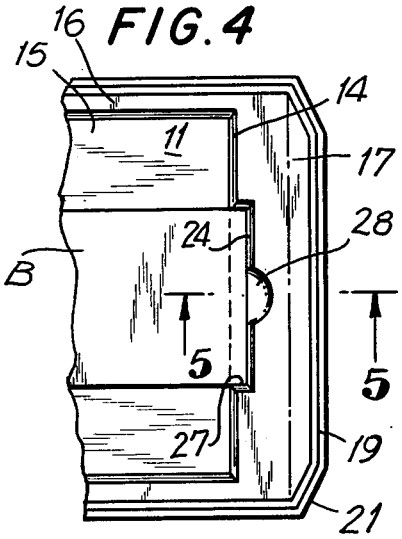
FIG. 4 is a fragmentary top plan view thereof shown housing a standard cassette.
Figure 3:
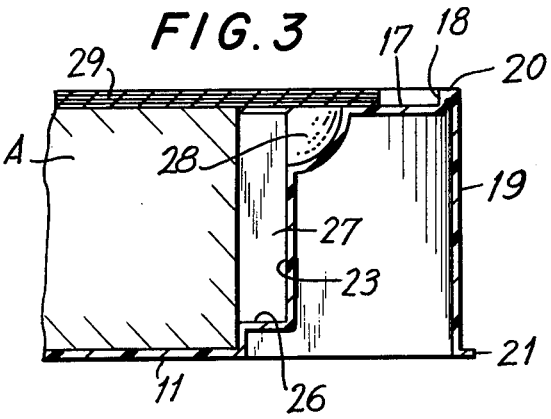
FIG. 3 is a sectional view taken along line 3—3 in FIG. 2, shown holding a pamphlet.
Figure 5:
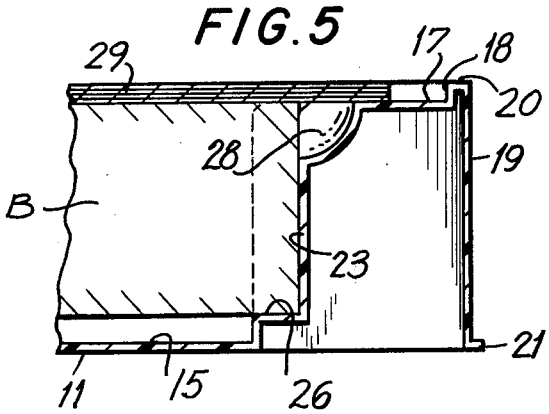
FIG. 5 is a sectional view taken along line 5—5 in FIG. 4 shown holding a pamphlet.

In employing the improved receptacle 10, a catridge A is nested in cavity 15 as shown in FIG. 2, or a cassette B is dropped into the cavity 15 as shown in FIG. 4, with the ends of the cassette B engaging the recesses 22 and resting on shoulders 26. In either case, the top face of the cartridge or cassette is coplanar with the flanges 16 and 17, and a rectangular panel, for example a pamphlet 29, is deposited onto the flanges 16 and 17 and onto the coplanar top face of the cartridge or cassette within the boundary of the peripheral lip 18. The cartridge or cassette-holding receptacle 10 may then be inserted into a cardboard shipping container of uniform size of may be otherwise uniformly handled.

Figure 6:
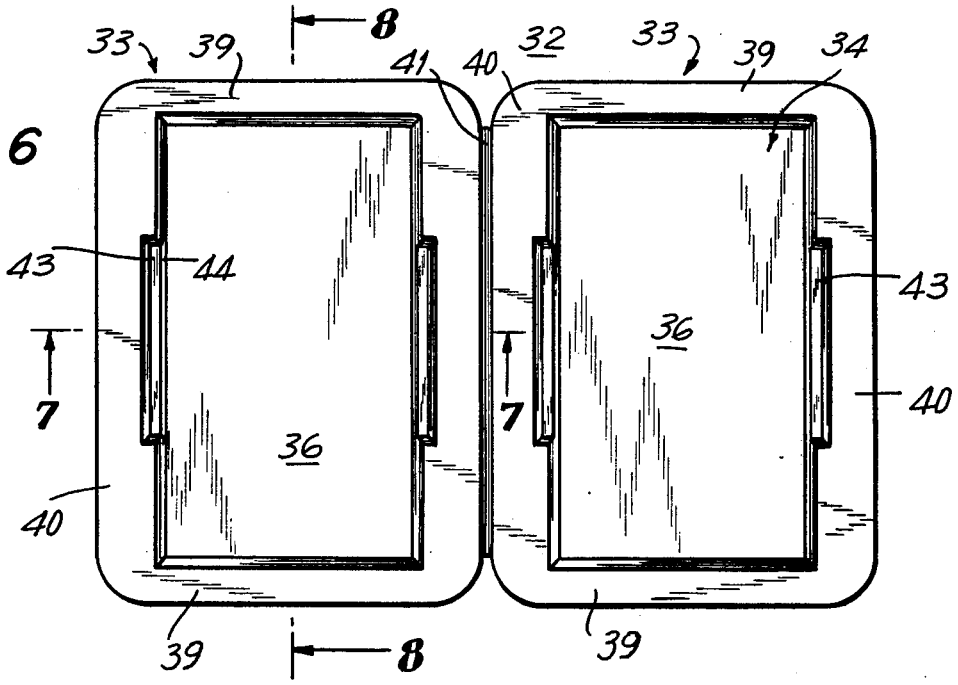
FIG. 6 is a top plan view of another embodiment of the present invention.
Figure 7:
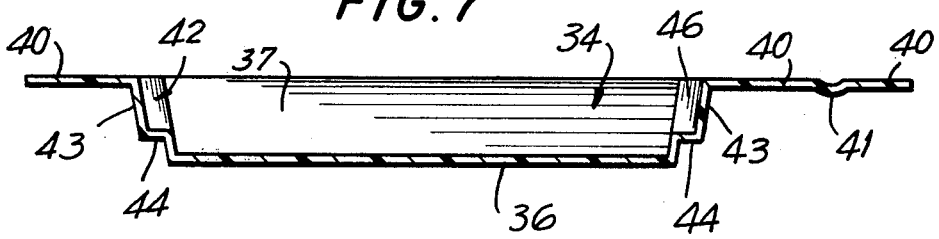
FIG. 7 is a fragmentary sectional view taken along line 7—7 in FIG. 6.
Figure 8:
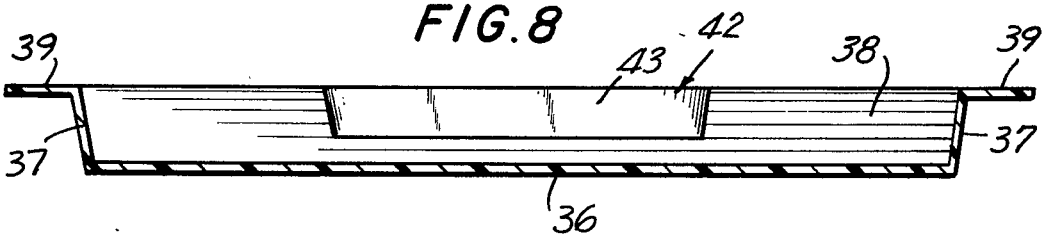
FIG. 8 is a sectional view taken along line 8-8 in FIG. 6.

In FIGS. 6 to 8 of the drawings there is illustrated another embodiment of the present invention which differs from that first described primarily in that a pair of self hinged receptacle members are provided basically similar to the receptacle 10 except that the heights of the cavity and recess are half the height of the cartridge and recess respectively. Specifically, the modified receptacle 32 includes a pair of similar tray-shaped receptacle members 33 each having a cavity 34 delineated by a rectangular base wall 36 and upwardly outwardly inclined transverse side walls 37 and front and elongated longitudinal front and rear walls 38. Side walls 37 terminate in narrow outwardly projecting horizontal flanges 39, and the longitudinal walls terminate in outwardly projecting wide horizontal flanges 40, the proximate flanges 40 of adjacent receptacle sections being joined by an integral self hinge 41.

Medially formed in the confronting faces of longitudinal walls 38 are similar roughly rectangular or slightly trapezoidal recesses 42 delineated by an inner upwardly slightly outwardly inclined base wall 43, a horizontal bottom shoulder 44 located above cavity base wall 36, and upwardly outwardly inclined side shoulders 46. The length and width of each cavity 34 are about equal to those of a standard cartridge A and the height thereof is half of that of the cartridge. The width of each recess 42 is about half that of the cassette and the distance between the confronting recess bases 43 of each pair is about the length of the cassette.

In use of the receptacle 32, a cartridge A is partially nested in the cavity 34 of one of the receptacle members 33 and the other receptacle member is swung to a closed position to matingly engage the cartridge, or a cassette B is deposited with its ends engaging respective recesses 42 of one of the receptacle members resting on the shoulders 44 and the other receptacle member is swung to a closed position to tightly encompass the cassette. The cartridge or cassette-carrying receptacle is then handled or applied as desired.

While there have been described and illustrated preferred embodiments of the present invention, it is apparent that numerous alterations, omissions, and additions may be made without departing from the spirit thereof.

I claim:

1. A receptacle for selectively alternatively holding a standard tape recording cartridge or standard tape recording cassette which are of rectangular configuration and of different dimensions, said receptacle being integrally formed and comprising a rectangular base wall and front and rear longitudinal and transverse side, peripheral walls projecting upwardly from the edges of said base wall and delineating an open topped cavity of a depth approximately equal to the height of said standard cartridge and in which said cartridge is nestable, said front and rear walls having formed in their confronting faces opposed transversely aligned rectangular recesses each of a height approximately equal to that of said standard cassette and bordered by side shoulders and a bottom shoulder disposed above said cavity base wall and provided with a base wall, the distance between the side shoulders of each recess being approximately equal to the width of said standard cassette and the distance between opposing recess bases being approximately equal to the length of said standard cassette, coplanar peripheral flanges projecting outwardly from the top edges of said peripheral walls and an upwardly directed peripheral lip projecting upwardly from the outer edges of said flanges.

2. The receptacle of claim 1 wherein the upper borders of said longitudinal walls and the adjacent borders of said flanges projecting therefrom have finger accomodating concavities formed therein.

3. The receptacle of claim 1 including a skirt wall depending from said peripheral lip and outwardly offset therefrom and terminating at the level of said base wall.

4. A receptacle for selectively alternatively holding a standard tape recording cartridge or standard tape recording cassette which are of rectangular configuration and of different dimensions, said receptacle being integrally formed and comprising a pair of laterally spaced similar receptacle sections of each of which comprises a rectangular base wall and front and rear longitudinal and transverse side, peripheral walls projecting upwardly from the edges of said base wall and delineating an open topped cavity of a depth approximately equal to one half the height of said standard cartridge and in which said cartridge is partially nestable, said front and rear walls having formed in their confronting faces opposed trasversely aligned rectangular recesses bordered by side shoulders and a bottom shoulder disposed above said cavity base wall and provided with a base wall, the height of each of said recesses being approximately equal to half of that of said standard cassette and the distance between the side shoulders of each recess being approximately equal to the width of said standard cassette and the distance between opposing recess bases being approximately equal to the length of said standard cassette, and coplanar flanges projecting outwardly from the top edges of said peripheral walls of said receptacle sections, a pair of corresponding flanges being proximate each other and being joined by integrally formed self hinge.

* * * * *